US005282759A

United States Patent [19]

Sakamoto et al.

[11] Patent Number: 5,282,759

[45] Date of Patent: Feb. 1, 1994

[54] MODULAR JACK

[75] Inventors: Yukio Sakamoto; Iwao Fukutani; Toshio Hori, all of Nagaokakyo, Japan

[73] Assignee: Murata Manufacturing Co., Ltd., Nagaokakyo, Japan

[21] Appl. No.: 942,833

[22] Filed: Sep. 10, 1992

[30] Foreign Application Priority Data

Sep. 13, 1991 [JP] Japan ..... 3-234286

[51] Int. Cl.[5] ..... H01R 13/66

[52] U.S. Cl. ..... 439/620; 333/185

[58] Field of Search ..... 439/620; 333/181-185

[56] References Cited

U.S. PATENT DOCUMENTS 4,329,665 5/1982 Kawai et al. ..... 333/182
4,695,115 9/1987 Talend ..... 439/620
4,772,224 9/1988 Talend ..... 439/607
4,772,225 9/1988 Ulery ..... 439/620
4,804,332 2/1989 Pirc ..... 439/620
4,880,397 11/1989 Dawson, Jr. et al. ..... 439/620
5,015,204 5/1991 Sakamoto et al. ..... 439/620
5,069,641 12/1991 Sakamoto et al. ..... 439/620
5,139,442 8/1992 Sakamoto et al. ..... 439/620

*Primary Examiner*—Gary F. Paumen
*Attorney, Agent, or Firm*—Burns, Doane, Swecker & Mathis

[57] ABSTRACT

A modular jack to be mounted on a circuit board, the modular jack having contactors which will come into contact with a plug and terminals which will be connected with printed wires on the circuit board. The contactors and the terminals are stamped out of a hoop and fixed in a body case of the modular jack. An end of the contactors and an end of the terminals are arranged nearby, and filter elements for eliminating noise are disposed between the nearby ends.

20 Claims, 8 Drawing Sheets

FIG. 10
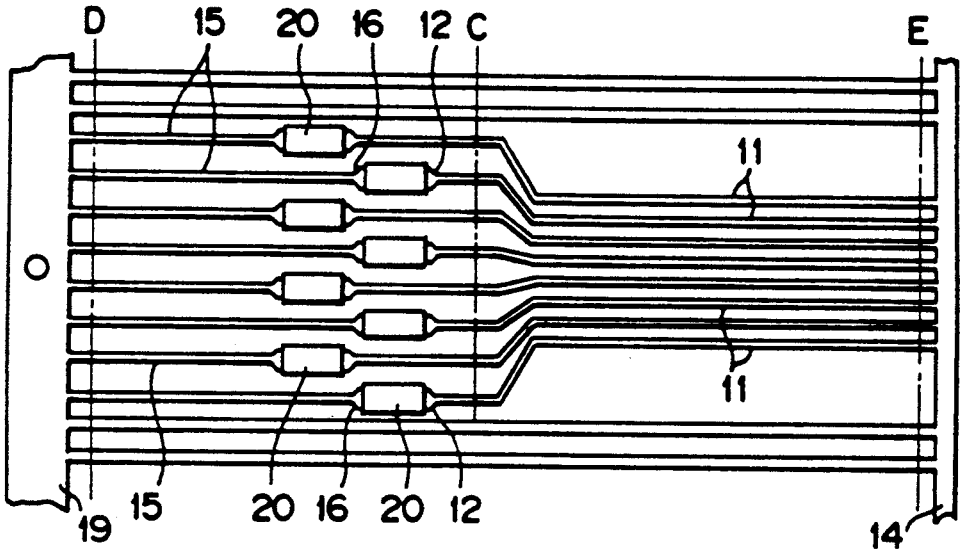
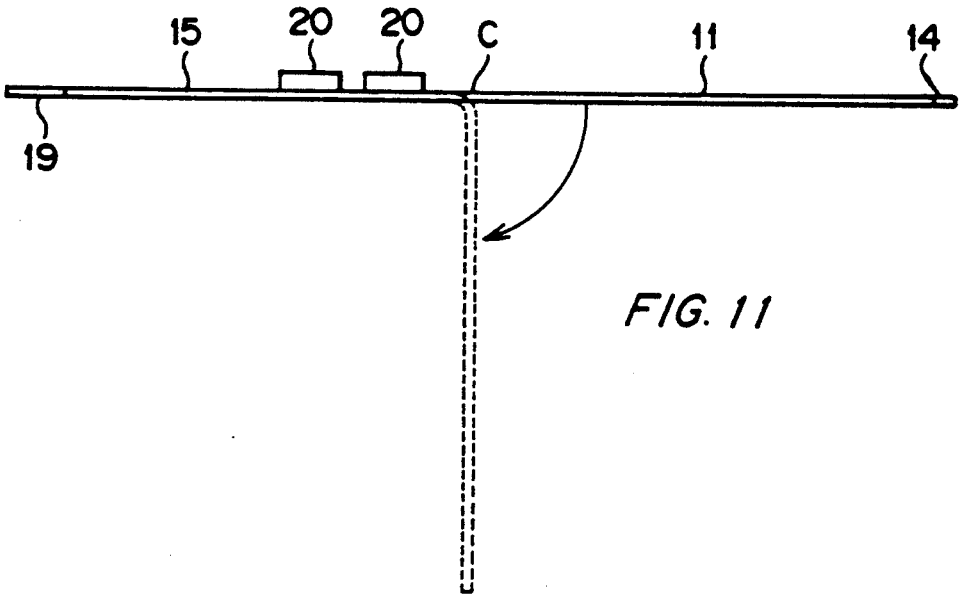
FIG. 11

MODULAR JACK

BACKGROUND OF THE INVENTION

1. Field of the Invention

The present invention relates to a modular jack, and more particularly to a modular jack which is to be mounted on a circuit board of an electronic appliance such as a telephone, a facsimile or the like to connect the electronic appliance with a telephone line.

2. Description of Related Art

In an electronic appliance which employs a modular jack, in order to eliminate noise, conventionally a filter such as a three-terminal capacitor or a common mode choke coil is provided on a circuit board separately from the modular jack. However, providing a filter and a modular jack separately complicates the production of the circuit board, and the produced circuit board will be large.

In the light of these problems, we disclosed in U.S. Pat. No. 5,015,204 a modular jack containing a common mode choke coil which comprises a ring-shaped core and two coils coiled thereon. One end of the coils is made to be a contactor with a plug, and the other end is made to be a terminal used for mounting of the modular jack on a circuit board. The modular jack has advantages that it functions as a noise suppressor because it contains a common mode choke coil and that it is compact because a coil, a contactor and a terminal are made into a unit. However, the modular jack has the following drawbacks. In order to increase the number of circuits, more space for more cores is required, and the modular jack cannot be made compact. The electrode pitch of a circuit board is ordinarily 1.02 mm, but the terminal pitch of the modular jack is more than 1.02 mm because of the cores. Therefore, a newly designed circuit board is required.

Further, we disclosed in U.S. Pat. No. 5,069,641 a modular jack which contains a printed board having chip type filter elements in a housing.

SUMMARY OF THE INVENTION

An object of the present invention is to provide a modular jack which can be made compact regardless of the number of circuits, which can set the terminal pitch arbitrarily and which can employ any filter element proper for each signal line.

In order to attain the object, a modular jack according to the present invention comprises a body case; contactors and terminals fixed in the body case; and filter elements for eliminating noise. One end of the contactors is led into an opening in which a plug is to be inserted, and one end of the terminals is protruded from the body case so as to be connected with the circuit board. The other ends of the contactors and the terminals are arranged nearby. The filter elements are practically chip inductors, chip coils or the like, and they are disposed between the nearby ends of the contactors and the terminals.

In the above structure, the filter elements can be mounted in the body case compactly regardless of the number of circuits. The pitch among the terminals can be set arbitrarily, and therefore it is easy to fit the terminal pitch to the pitch among electrodes on the circuit board (ordinarily 1.02 mm). Since the contactors and the terminals are separate, there is no fear that a flux which is used for soldering of the terminals to the circuit board may penetrate to the contactors. Thereby, the contactors keeps high reliability. The filter elements are connected with the contactors and the terminals directly, and no fitting board is required. Further, using chip type filter elements makes it possible to employ a filter element which has an optimal characteristic for each signal line.

Preferably, the contactors and the terminals are stamped out of a hoop and insert-molded in the body case. In this case, the contactors and the terminals are inserted in the case such that their nearby ends will be exposed on a surface of the body case, and thereafter the filter elements are disposed between the ends. Alternatively, the filter elements are connected between the nearby ends of the contactors and the terminals, and thereafter the contactors and the terminals are insert-molded in the body case. Since the contactors and the terminals are insert-molded in the body case, bending of the contactors to lead the end into the opening can be carried out stably and accurately by using a part of the body case as a guiding/positioning member. The contactors and the terminals are securely fixed in the body case by the insert molding, and therefore a stress generated at the time of mounting the modular jack on the circuit board and a stress generated at the time of inserting the plug into or pulling out of the opening will not affect the filter elements. Moreover, if the filter elements are disposed between the contactors and the terminals after the bending of the contactors, a stress generated at the bending will not affect the filter elements. Instead of the insert molding, the contactors and the terminals can be pressed and fitted into grooves formed on a surface of the body case.

BRIEF DESCRIPTION OF THE DRAWINGS

This and other objects and features of the present invention will be apparent from the following description with reference to the accompanying drawings in which:

FIG. 1 is a side view of the modular jack showing its components;

FIG. 2 is a plan view of contactors and terminals stamped out of a hoop;

FIG. 3 is a front view of the contactors and the terminals;

FIG. 4 is a perspective view of a body case containing the contactors, the terminals and chip inductors;

FIG. 5 is a perspective view of a cover;

FIG. 6 is a plan view of a capacitor array;

FIG. 7 is a bottom view of the capacitor array;

FIG. 8 is a perspective view of a grounding terminal;

FIG. 9 is an equivalent circuit of the modular jack;

FIG. 10 is a plan view of contactors and terminals which are to be employed in a modular jack which is a second embodiment of the present invention, the contactors and the terminals being stamped out of a hoop and provided with chip inductors;

FIG. 11 is a front view of the contactors and the terminals;

DETAILED DESCRIPTION OF THE PREFERRED EMBODIMENTS

Some exemplary modular jacks according to the present invention are hereinafter described with reference to the accompanying drawings.

First Embodiment: FIGS. 1-9

Figure 1:
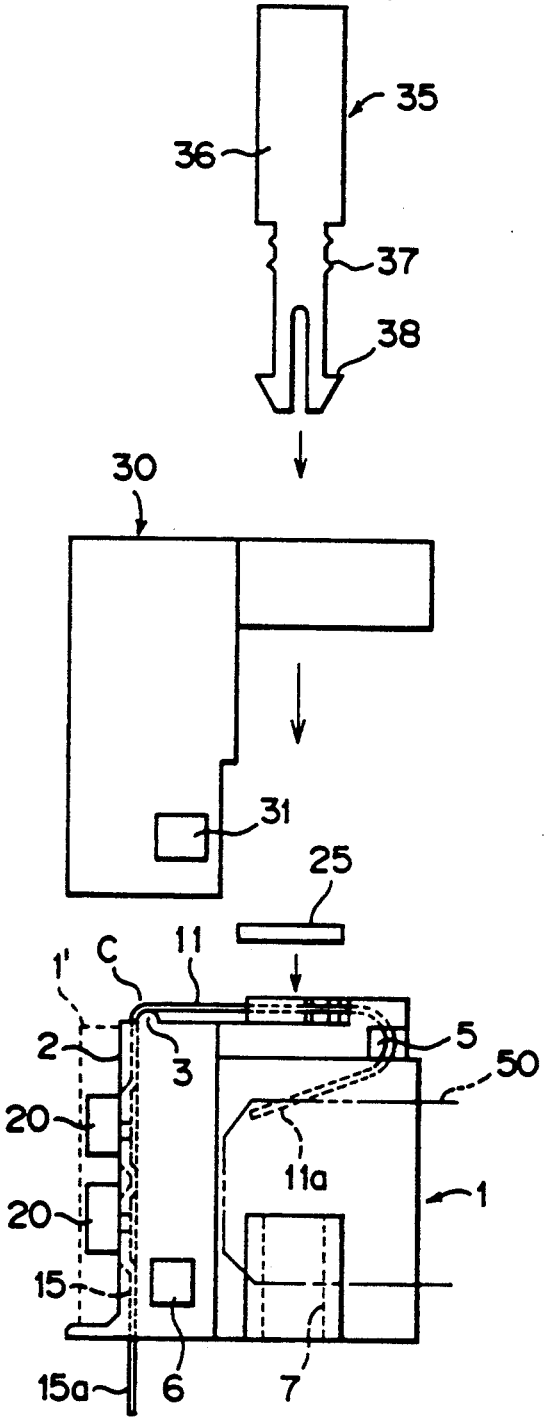
FIGS. 1 through 9 show a modular jack which is a first embodiment of the present invention.

Referring to FIG. 1, a modular jack comprises a body case 1, contactors 11, terminals 15, chip inductors 20, a capacitor array 25, a cover 30 and a grounding terminal 35.

The body case 1 is molded out of resin, and at the right side in FIG. 1, the body case 1 has an opening in which a modular plug 50 is inserted.

Figure 2:
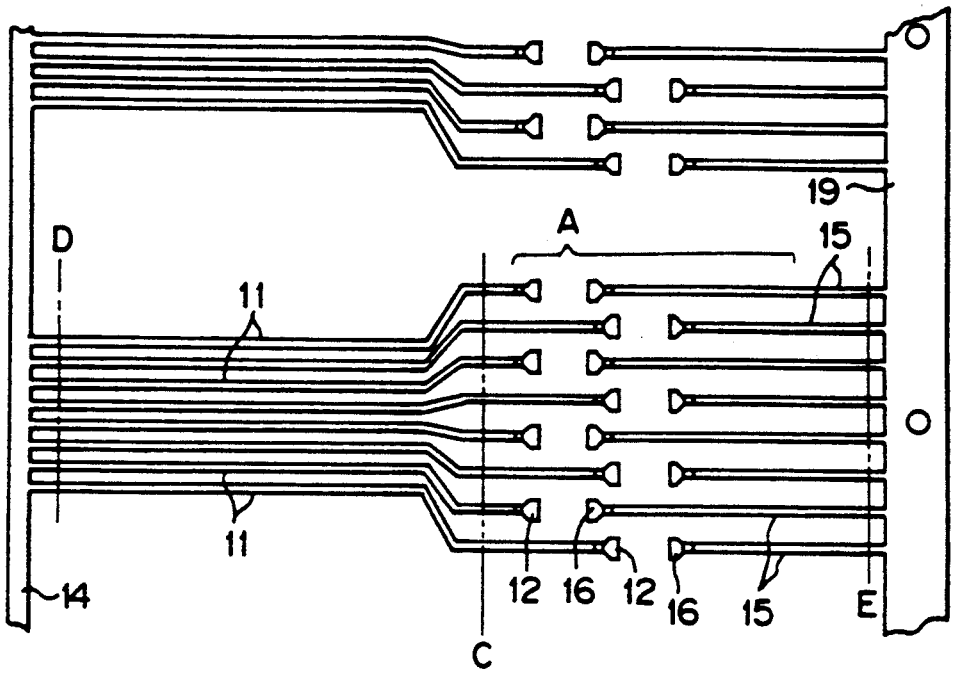
Figure 3:
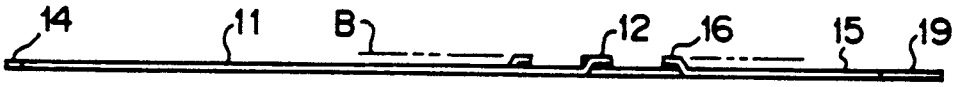
Figure 4:
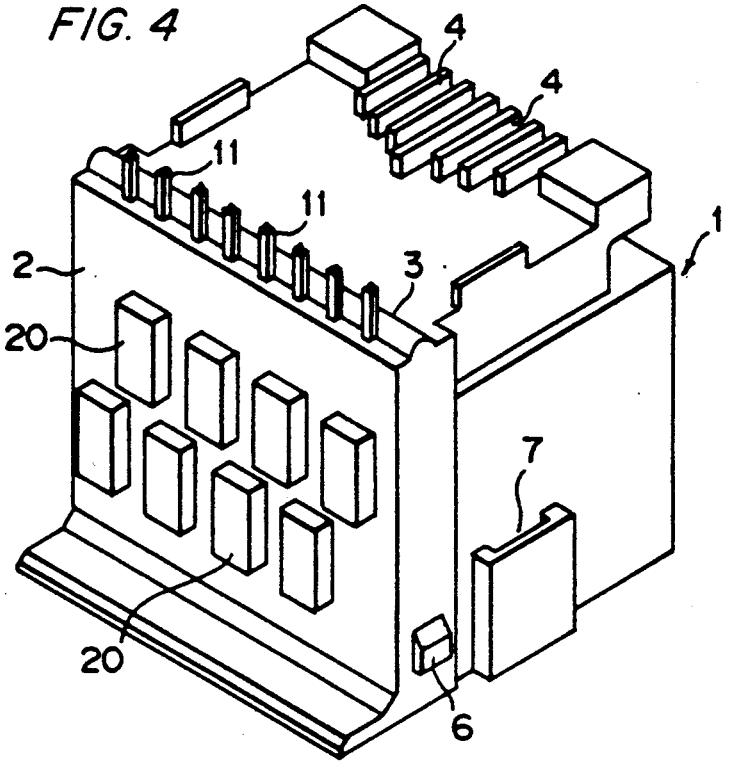

Referring to FIGS. 2 and 3, the contactors 11 and the terminals 15 are stamped out of an elastic and conductive hoop such as phosphor bronze, and eight contactors and eight terminals are made as one unit to be employed in a modular jack. Immediately after the stamping of contactors 11 and terminals 15, a connecting portion 14 is left so as to connect the contactors 11 with one another, and a connecting portion 19 is left so as to connect the terminals 15 with one another. Free ends of the contactors 11 and the terminals 15 are facing to each other. The contactors 11 and the terminals 15 are plated and thereafter are insert-molded in the body case 1 such that a part A indicated in FIG. 2 is inserted in a side wall 2. The insertion is carried out such that electrodes 12 and 16 of the contactors 11 and the terminals 15 show on the side wall 2. Specifically, the electrodes 12 and 16 are on a level with the surface of the side wall 2 as indicated with a two-dot chain line B in FIG. 3.

The contactors 11 and the terminals 15, after being insert-molded in the body case 1, are cut at dashed lines D and E respectively. Next, the contactors 11 protruded from the upper edge of the side wall 2 are bent at a portion C, guided by a protrusion 3 formed on an upper side of the body case 1, to be laid along the upper side of the body case 1. The contactors 11 are further bent, guided by grooves 4 formed on the upper side and a protrusion 5 formed on a front side such that ends 11*a* of the contactors 11 are led into the opening. Thereby, the plug 50 inserted into the opening comes into contact with the contactors 11. The terminals 15 protrudes their end portions 15*a* from the bottom edge of the side wall 2, and the end portions 15*a* come into contact with electrodes on a circuit board of an electronic appliance.

The chip inductors 20 are of conventional type and function as choke coils eliminating high frequency noise. The chip inductors 20 are soldered so as to be laid between the electrodes 12 and 16 exposed on the side wall 2.

Figure 5:
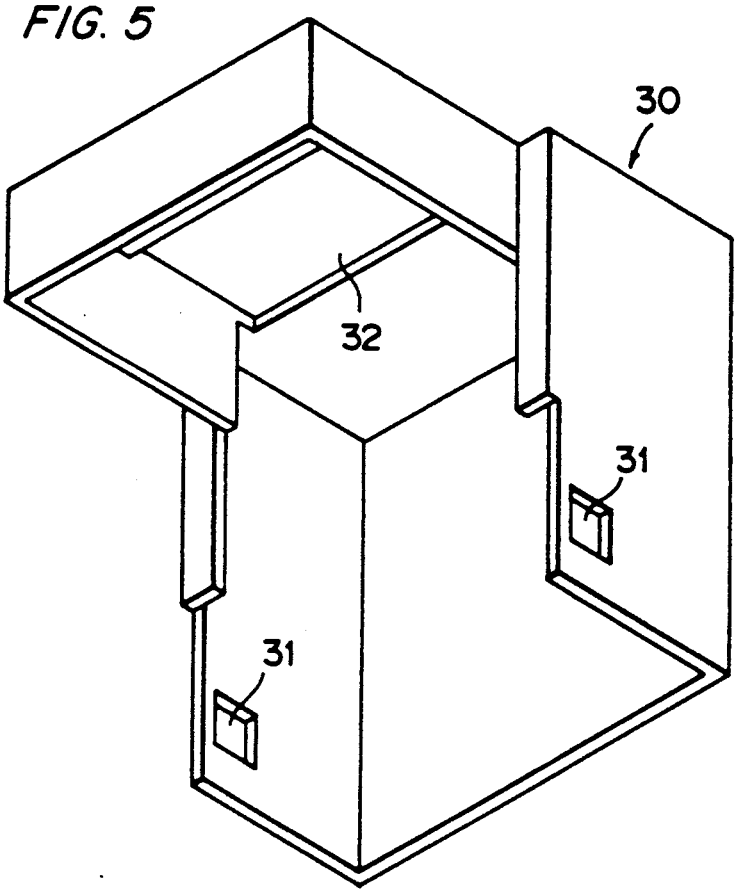

Referring to FIG. 5, the cover 30 is molded out of resin. The cover 30 has an opening 32 in its ceiling and has holes 31 in both sides. By engaging the holes 31 with protrusions 6 of the body case 1, the cover 30 is locked on the body case 1 and covers the contactors 11 and the chip inductors 20.

Figure 6:
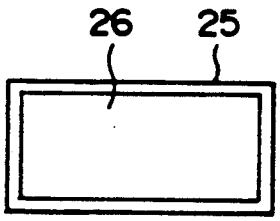
Figure 7:
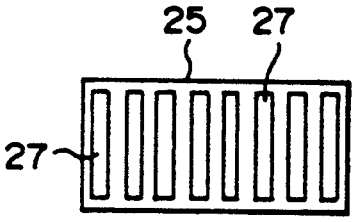

Referring to FIGS. 6 and 7, the capacitor array 25 has a common electrode 26 on one side of a dielectric substrate and individual electrodes 27 on the other side. The number of individual electrodes 27 is equal to the number of signal lines. In this embodiment, eight individual electrodes 27 are provided. The individual electrodes 27 come into contact with the contactors 11 on the upper side of the body case 1, and the common electrode 26 is exposed at the opening 32 of the cover 30.

Figure 8:
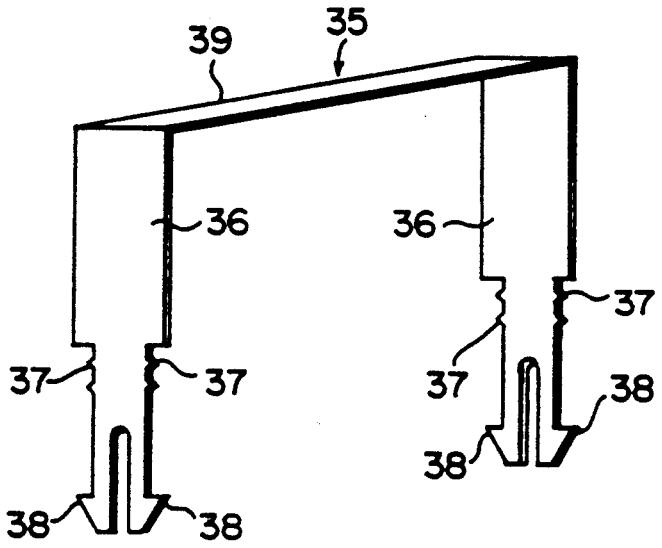

The grounding terminal 35 is made of a conductive metal. As shown in FIG. 8, the grounding terminal 35 comprises a right and a left side plate 36 and a connecting plate 39. By inserting the side plates 36 in slots 7 disposed on sides of the body case 1 until small projections 37 get stuck in the respective slots 7, the grounding terminal 35 is fixed on the body case 1. In this state, the connecting plate 39 of the grounding terminal 35 is in contact with the common electrode 26 of the capacitor array 25. The side plates 36 of the grounding terminal 35 protrude their claws 38 from the slots 7, and the claws 38 are inserted into holes of the circuit board of the electronic appliance and soldered to a grounding line formed on the circuit board. In this way, the common electrode 26 of the capacitor array 25 is connected with the grounding line of the electronic appliance through the grounding terminal 35.

Figure 9:
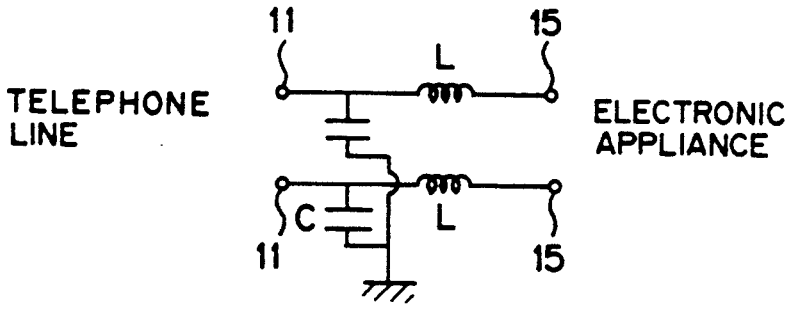

FIG. 9 shows an equivalent circuit (of two lines) of the above-structured filter built-in type modular jack. The contactors 11 are in contact with the plug 50 and thereby connected with the telephone line. The terminals 15 are soldered to the signal lines of the circuit board and thereby are connected with a receiving section of the electronic appliance such as a telephone or a facsimile. Noise coming through the telephone line is eliminated by the chip inductors 20 and the capacitor array 25.

In the first embodiment, the chip inductors 20 and the capacitor array 25 act as a filter, and the filter is extremely compact. More specifically, this eight-line modular jack is almost the same size as a conventional two-line modular jack. The terminals 15 can be so made as to have any desired pitch among them. Therefore, the terminal pitch can be set to correspond to the ordinary electrode pitch 1.02 mm of a circuit board.

Since the contactors 11 and the terminals 15 are separate, soldering of the terminals 15 to the circuit board will not cause penetration of a flux to the contactors 11, and the reliability of the contactors 11 is improved. The filter (the chip inductors 20 and the capacitor array 25) is connected to the contactors 11 and the terminals 15 directly without using a board. Thereby, the modular jack as a whole can be downsized. Moreover, it is possible to provide a chip inductor having an optimal characteristic for each signal line.

Since the contactors 11 and the terminals 15 are insert-molded in the body case 1, the fitting is so strong that a stress applied to the terminals 15 when the terminals 15 are inserted in the holes of the circuit board and a stress applied to the contactors 11 when the plug 50 is inserted and pulled out will not affect the chip inductors 20. Since the bending of the contactors 11 is guided by the protrusion 3, the grooves 4 and the protrusion 5 of the body case 1, the bending is stable and accurate. Since the chip inductors 20 are soldered to the contactors 11 and the terminals 15 after the insert molding of the contactors 11 and the terminals 15 in the body case 1 and the bending of the contactors 11, a stress caused by the bending does not affect the chip inductors 20, and the chip inductors 20 are not degraded.

Second Embodiment: FIGS. 10 and 11

FIGS. 10 and 11 show the contactors 11, the terminals 15 and the chip inductors 20 installed in a modular jack of a second embodiment. The contactors 11 and the terminals 15 are stamped out of a hoop and plated. In the second embodiment, immediately after the plating, the chip inductors 20 are soldered to the electrodes 12 and 16 of the contactors 11 and the terminals 15. Then, the contactors 11 and the terminals 15 with the chip inductors 20 attached thereto are insert-molded in the body case 1 as depicted, for example, by the dotted line 1' in FIG. 1. In the second embodiment, the electrodes 12 and 16 do not have to be exposed on the side wall of the body case and accordingly do not have to be bent to be protruded to a different level as shown in FIG. 3.

In the other points, the structure of the second embodiment is the same as that of the first embodiment, and the function and effect of the second embodiment are the same as those of the first embodiment.

Figure 12:
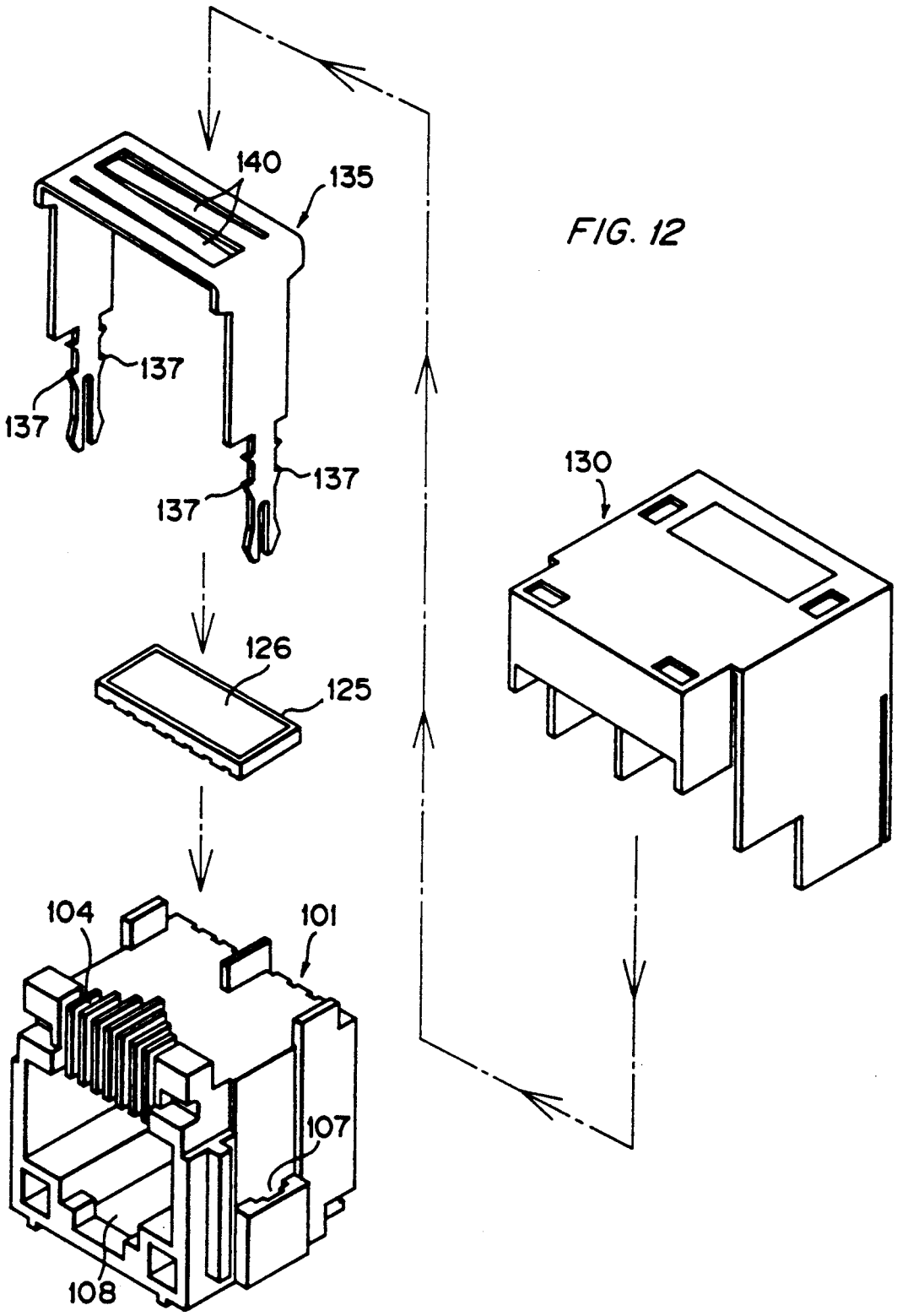
FIG. 12 is an exploded perspective view of a modular jack which is a third embodiment of the present invention.
Figure 13:
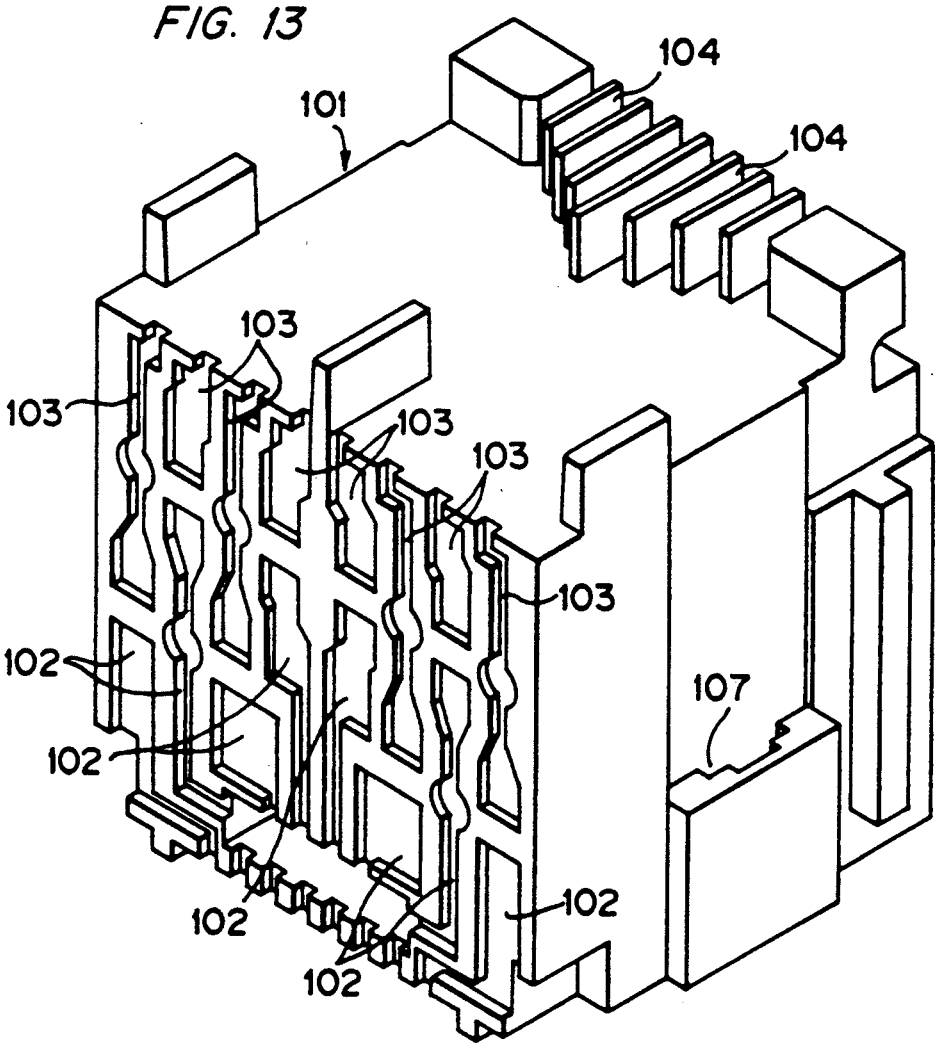
FIG. 13 is a perspective view of a body case of the modular jack.
Figure 14:
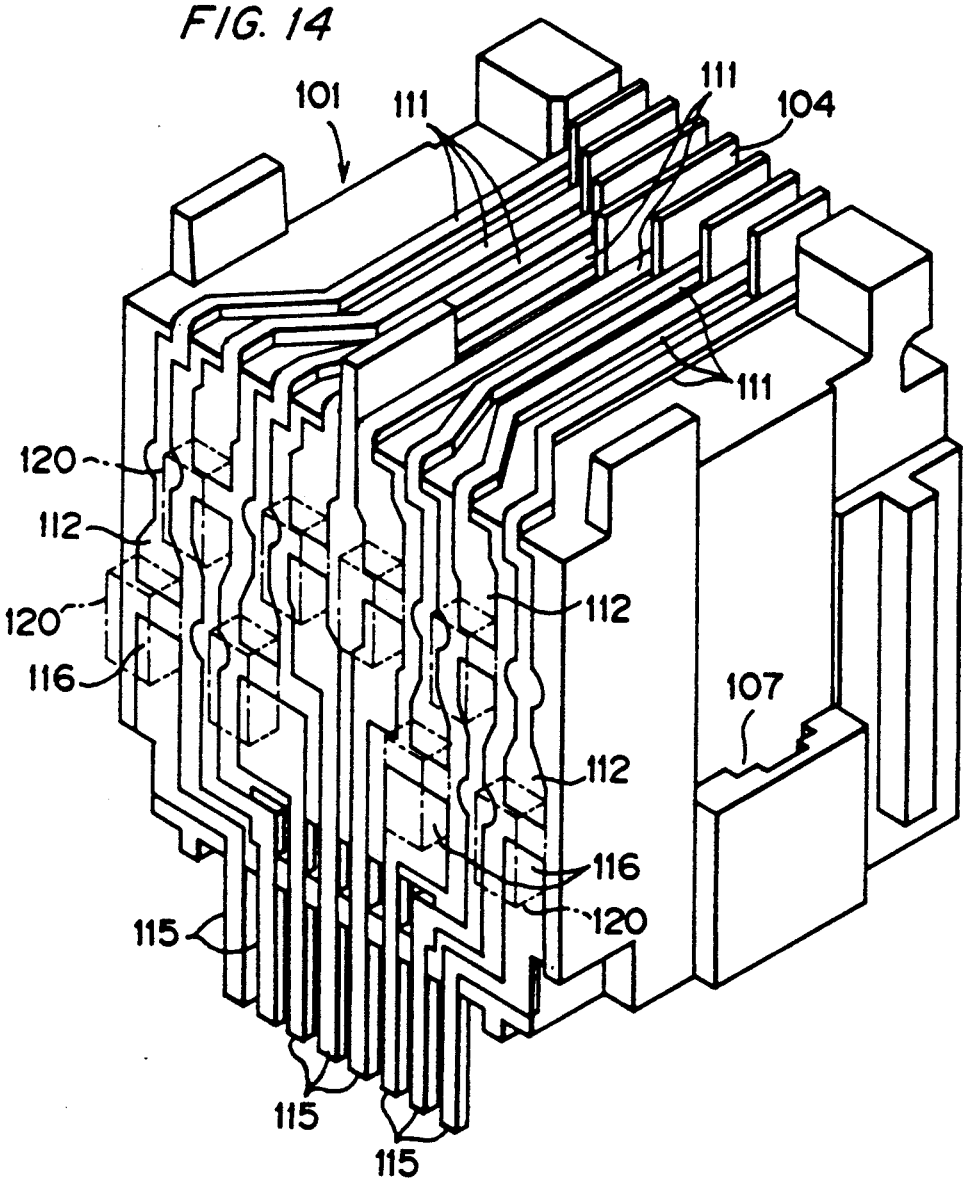
FIG. 14 is a perspective view of the body case containing contactors, terminals and chip inductors.

Third Embodiment: FIGS. 12, 13 and 14

The structure of a third embodiment is basically the same as that of the first embodiment. The third embodiment is different from the first embodiment in the following points. Contactors 111 and terminals 115 which are stamped out of a hoop are fixed on a body case 101 by pressing and fitting the contactors 111 and the terminals 115 in grooves 102 and 103 formed on a rear side of the body case 101. Instead of the capacitor array 25, a varistor array 125 is provided.

Electrodes 112 of the contactors 111 and electrodes 116 of the terminals 115 are arranged nearby, and chip inductors 120 are soldered so as to be laid between the electrodes 112 and 116. The contactors 111 are bent, guided by grooves 104 toward an opening 108 formed in a front side of the body case 101.

The varistor array 125 has a common electrode 126 on one side of a dielectric substrate and individual electrodes (not shown) on the other side. The number of individual electrodes is equal to the number of signal lines. The individual electrodes of the varistor array 125 are in contact with the contactors 111, and the common electrode 126 is in contact with a grounding terminal 135. The grounding terminal 135 is fixed on the body case 101 by inserting their side plates into slots 107 disposed at sides of the body case 101 until small projections 137 get stuck in the respective slots 107. The body case 101 with the grounding terminal 135 fixed thereon is further covered with a cover 130. The grounding terminal 135 has two protrusions 140 which elastically press the varistor array 125 against the contactors 111 on the upper side of the body case 101.

Other Embodiments

Although the present invention has been described in connection with the preferred embodiments above, it is to be noted that various changes and modifications will be possible to those who are skilled in the art. Such changes and modifications are to be understood as being within the scope of the present invention.

In the first embodiment, the chip inductors 20 and the capacitor array 25 act as a filter, and in the third embodiment, the chip inductors 120 and the varistor array 125 act as a filter. However, the capacitor array 25 and the varistor array 125 are not indispensable. It is possible to provide, instead of the chip inductors 20, three-terminal chip capacitors or a filter array which has filter elements on a substrate. Moreover, the terminals can be protruded from the bottom of the body case staggeringly.

What is claimed is:

1. A modular jack comprising:

a body case having grooves on a surface thereof;

a contactor and a terminal which are press-fit into the grooves, a first end of the contactor being in operable contact with a plug opening of the modular jack, a first end of the terminal protruding from the body case for connection with a circuit board, each of said contactor and said terminal having a second end; and a filter element for reducing noise, the filter element being directly connected electrically with the second ends of the contactor and the terminal.

2. A modular jack as claimed in claim 1, wherein the contactor and the terminal are stamped out of a hoop into specified shapes.

3. a modular jack as claimed in claim 1, wherein the filter element is a chip inductor.

4. A modular jack comprising:

a body case having grooves on a surface thereof;

a contactor and a terminal which are press-fit into the grooves, a first end of the contactor being in operable contact with a plug opening of the modular jack, a first end of the terminal protruding from the body case for connection with a circuit board, each of said contactor and said terminal having a second end;

a first filter element for reducing noise, the filter element being directly connected electrically with the second ends of the contactor and the terminal;

a grounding terminal fixed on the body case, the grounding terminal having two side portions and a connecting portion between the side portions, each of the side portions having a claw for electrical connection with a grounding line formed on the circuit board; and a second filter element for reducing noise, the second filter element being disposed between the contactor and the connecting portion of the grounding terminal.

5. A modular jack as claimed in claim 4, wherein the contactor and the terminal are stamped out of a hoop into specified shapes.

6. A modular jack as claimed in claim 4, wherein the second filter element is a capacitor.

7. A modular jack as claimed in claim 4, wherein the second filter element is a varistor.

8. A modular jack as claimed in claim 4, wherein each of the side portions of the grounding terminal has a projection for fixing the grounding terminal to the body case.

9. A modular jack comprising:

a body case;

a contactor and a terminal fixed in the body case, a first end of the contactor being in operable contact with a plug opening of the modular jack, a first end of the terminal protruding from the body case for connection with a circuit board, each of said contactor and said terminal having a second end; and a filter element for reducing noise, the filter element being directly connected electrically with the second ends of the contactor and the terminal, said contactor and said terminal being stamped out of a hoop into specified shapes and insert-molded in the body case, with said second ends of the contactor and the terminal being exposed on a surface of the body case and connected with each other by the filter element.

10. A modular jack as claimed in claim 9, wherein the filter element is a chip inductor.

11. A modular jack as claimed in claim 9, further comprising:

a grounding terminal fixed on the body case, the grounding terminal having two side portions and a connecting portion between the side portions, each of the side portions having a claw for electrical connection with a grounding line formed on the circuit board; and a second filter element for reducing noise, the second filter element being disposed between the contactor and the connecting portion of the ground terminal.

12. A modular jack as claimed in claim 11, wherein the second filter element is a capacitor.

13. A modular jack as claimed in claim 11, wherein the second filter element is a varistor.

14. A modular jack as claimed in claim 11, wherein each of the side portions of the grounding terminal has a projection for fixing the grounding terminal to the body case.

15. A modular jack comprising:

a body case;

a contactor and a terminal fixed in the body case, a first end of the contactor being in operable contact with a plug opening of the modular jack, a first end of the terminal protruding from the body case for connection with a circuit board, each of said contactor and said terminal having a second end; and a filter element for reducing noise, the filter element being directly connected electrically with the second ends of the contactor and the terminal, said contactor and said terminal being stamped out of a hoop into specified shapes, the filter element being connected between the second ends of the contactor and the terminal, and thereafter insert-molded in the body case.

16. A modular jack as claimed in claim 15, wherein the filter element is a chip inductor.

17. A modular jack as claimed in claim 15, further comprising:

a grounding terminal fixed on the body case, the grounding terminal having two side portions and a connecting portion which connects with the side portions, each of the side portions having a claw for electrical connection with a grounding line formed on the circuit board; and a second filter element for reducing noise, the second filter element being disposed between the contactor and the connecting portion of the grounding terminal.

18. A modular jack as claimed in claim 17, wherein the second filter element is a capacitor.

19. A modular jack as claimed in claim 17, wherein the second filter element is a varistor.

20. A modular jack as claimed in claim 17, wherein each of the side portions of the grounding terminal has a projection for fixing the grounding terminal to the body case.

* * * * *